United States Patent [19]

Sakashita et al.

[11] Patent Number: 4,841,652

[45] Date of Patent: Jun. 27, 1989

[54] ADHESIVE SHEET

[75] Inventors: Hitoshi Sakashita, Urawa; Yoshihisa Mineura; Toshihiko Sato, both of Tokyo, all of Japan

[73] Assignee: Efuesukei Kabushiki Kaisha, Tokyo, Japan

[21] Appl. No.: 18,387

[22] Filed: Feb. 25, 1987

[30] Foreign Application Priority Data

Feb. 26, 1986 [JP] Japan ..... 61-39012

[51] Int. Cl.[4] ..... G09F 3/100

[52] U.S. Cl. ..... 40/299; 428/915

[58] Field of Search ..... 40/2 R, 625–626, 40/630; 283/81, 95; 428/40, 42, 915; 156/234, 344

[56] References Cited

U.S. PATENT DOCUMENTS

| | | | |
|---|---|---|---|
| 2,300,787 | 11/1942 | Ingliss | 283/95 |
| 3,925,584 | 12/1975 | Suzuki et al. | 428/915 |
| 3,950,870 | 4/1976 | Heegaard | 40/2 R |
| 4,121,003 | 10/1978 | Williams | 40/2 R |
| 4,180,929 | 1/1980 | Schultz, Jr. | 283/108 |
| 4,184,701 | 1/1980 | Franklin et al. | 40/2 R |
| 4,424,245 | 1/1984 | Maruta et al. | 428/40 |
| 4,526,405 | 7/1985 | Hattemer | 40/2 R |
| 4,661,195 | 4/1987 | Hopson | 156/584 |
| 4,700,207 | 10/1987 | Vanier et al. | 428/536 |

FOREIGN PATENT DOCUMENTS

| | | | |
|---|---|---|---|
| 2250456 | 5/1975 | France | 283/95 |

*Primary Examiner*—Gene Mancene
*Assistant Examiner*—Michael Lynch
*Attorney, Agent, or Firm*—Armstrong, Nikadio Marmelstein Kubovcik & Murray

[57] ABSTRACT

An adhesive sheet which comprises a support sheet and an adhesive layer containing a migratory substance, disposed on one side of the support sheet. This adhesive sheet may be applied to many types of articles and will leave behind a dye mark on the article indicating that it has been applied and subsequently removed.

13 Claims, 1 Drawing Sheet

ADHESIVE SHEET

BACKGROUND OF THE INVENTION

This invention relates to an adhesive sheet which when applied to an article will leave a mark on that article indicating that it has been applied and that it was subsequently removed from that article.

Before the present invention, two types of adhesive sheet designed to achieve the above result had been known to the art. The first type of adhesive sheet contained a supporting sheet made of a fragile material. An adhesive layer was coated on the rear surface of the fragile supporting sheet, as has been disclosed in U.S. Pat. No. 4,268,983. The second type of adhesive sheet designed to accomplish the above purpose, comprised a supporting sheet with a release agent applied to scattering portions of its rear surface. The entire rear surface of the supporting sheet was then coated with a metallic vapor deposition layer which in turn was coated with an adhesive layer. Both types of adhesive sheets known to the art may be used for identification, authentication, sealing and other purposes when applied to products, containers or identification cards. When the adhesive sheet mode comprising a supporting sheet of a fragile material is peeled from a product or container, the fragile supporting sheet is partially broken and a portion of that fragile supporting sheet remains on the surface of the product or container. When the adhesive sheet containing a metallic vapor deposition layer is removed from a product or container, broken parts of that metallic vapor deposition layer remain on the surface of the product or container. Thus, for both types of adhesive sheet the presence of a residue of the sheet or metallic vapor deposition layer on the product or container indicates that the adhesive sheet had been applied and was subsequently removed therefrom.

However, both types of adhesive sheet suffer from a serious drawback. Specifically, the residual parts of the sheet or metallic vapor deposition layer left behind on the product or container may be wiped away completely, thus removing any indication that the adhesive sheet had been applied and then peeled away. The principal purpose of the present invention is to provide an adhesive, sheet which does not suffer from this defect which plagues conventional adhesive sheets, but will indicate the fact that adhesive sheet has been removed even if residual parts of the sheet have been wiped away from the product or container.

SUMMARY OF THE INVENTION

Applicants' invention addresses the failing of the conventional art by incorporating a migratory substance into the adhesive layer of the adhesive sheet. One problem in the use of a migratory substance, such as a transferrable dye, in an adhesive sheet is that the migratory substance may migrate to the supporting sheet. Over time the appearance of the supporting sheet would then deteriorate. Further, although it is desirable for the supporting sheet to maintain the appearance of an ordinary adhesive sheet, the migration of a transferrable dye may destroy that ordinary appearance. This problem is addressed in one preferred embodiment of the present invention by the interposition of a dye anti-migration layer between the adhesive layer and the supporting sheet.

DETAILED DESCRIPTION OF THE INVENTION

Figure 1:
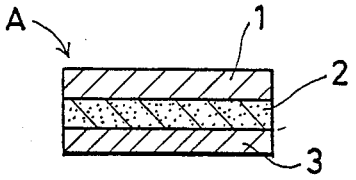
FIGS. 1 and 3–7 are sectional side views of the various embodiments of the inventive adhesive sheet.

FIG. 1 illustrates one embodiment of the present invention in which a supporting sheet 1 is coated with an adhesive layer 2. Release sheet 3 is temporarily adhered to the external surface of adhesive layer supporting sheet 1 may be made of any conventional material such as paper, board, synthetic polymeric sheet or film, metallic foil, metallic plate, etc., depending upon the level of strength or degree of transparency desired. A printing display comprising characters, patterns or marks may be applied to either or both the outer surface and the rear surface of the supporting sheet 1. The adhesive layer 2 may be made of various types of adhesives, including pressure sensitive adhesives and heat sensitive adhesives which are composed mainly of a tacky substance such as rubber, acrylic resin or the like commonly known to the art.

The migratory substance which is not shown in FIG. 1 but would be contained in adhesive layer 2 would be any substance which would migrate or transfer from the adhesive layer to the product or container when the adhesive sheet is adhered to that product or container. Preferable migratory substances are various types of dyes. Among these dyes are natural and synthetic dyes selected from the group of dispersed, cationic, basic, acidic, reactive, direct, sulfur, vat, azoic, mordant, fluorescent, oil soluble, fluorescent whiting dyes, etc. The most appropriate dye will depend upon the solvent used to prepare the adhesive and the material comprising the product or container to which the adhesive sheet is to be adhered. The dye may be added to the adhesive layer in an amount ranging from 0.01 to 10 parts by weight for each 100 parts by weight of the adhesive. The addition of the dye in an amount exceeding 10 parts by weight to the adhesive layer may reduce the tacky or adhesive force of the adhesive layer. Preferably the dye is added in an amount ranging from 0.05 to 5 parts by weight for each 100 parts by weight of adhesive.

Figure 2:
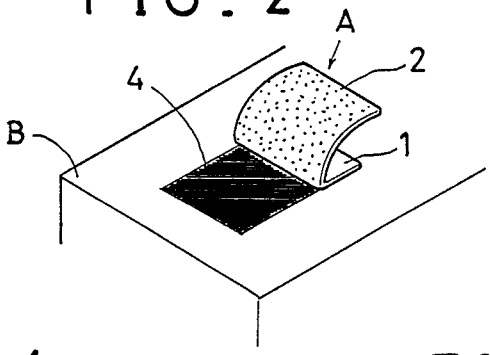
FIG. 2 is a perspective view of the condition of the inventive adhesive sheet and of an object to which it had been applied and from which it had subsequently been peeled.

As illustrated in FIG. 2, once an adhesive sheet A has been adhered to an object B and is subsequently peeled off, a noticeable dye mark 4 will remain on the surface of the object B over the area from which the adhesive sheet has been peeled. Thus for the purpose of detecting removal of the adhesive sheet, it is not essential to interpose a vapor deposition layer between the supporting sheet and the adhesive layer.

The present invention includes adhesive sheets corresponding to the two types of conventional design described above in which the adhesive layer therein has been modified by the addition of a migratory substance. In both instances, if the adhesive sheet is peeled from a product or container after having been adhered to that product or container, there remains on the surface of that product or container dye mark at the peeled site of the adhesive sheet. Even if the residue of the "fragile material" type supporting sheet or the residue of the broken parts of the "metallic vapor deposition" type adhesive is wiped off the product or container, the migratory substance which is transferred to the product or container cannot be wiped off, as will be explained in greater detail below. The present invention thus addresses the principal problem with the conventional adhesive sheets known to the art.

The present invention offers the further advantage that when an adhesive sheet is peeled from a product or container the dye mark left behind on the surface reflects the shape of the adhesive sheet of the removed adhesive sheet. Thus, in addition to detecting any malicious removal of the adhesive sheet, the present invention may be used as a positioning device in various manufacturing procedures in which the positioning of a certain member is desired.

The present invention thus has applications beyond those of conventional adhesive sheets. The adhesive sheets in manufacturing applications may be in the mode adhesive plates which may be made from various kinds of materials, such as metallic plate, hard board or the like. The size and shape of the present invention may be modified as desired. Further, the present invention may be in the mode of an adhesive label, adhesive tape, in the form of a flat sheet or in a rolled form etc.

Additionally, the present invention may be prepared with printing display on the surface of the adhesive sheet, through the use of printing presses such as an offset printing press, a lithographic press, a thermal printer or the like. The printing display may be for any purpose including the indication of a quality guarantee of the good, lot numbers of products, identification of persons, etc. In one use, the present inventive adhesive sheet may bear a printed indication of a specific production lot number and be adhered to a predetermined portion of an automobile or part thereof. Even if the adhesive label is thereafter peeled from the automobile or part thereof, a mark from the migratory substance remains on the surface of the automobile or part thereof and can be detected.

It is characteristic of the present inventive adhesive sheet that once it has been peeled from an object the fact of such peeling can be detected even if the torn pieces of the supporting sheet and the broken parts of the metallic vapor deposition layer are removed from the object and even if the foregoing attempts to remove the dye from the object are undertaken. Although a theoretical analysis is not essential to the practice of the present invention, applicants believe that the fact that the migrated dyes cannot be removed by solvents, as discussed below, is caused by the absorption or penetration of the migrated dyes into the surfaces of the objects.

In the course of producing, storing and using various types of adhesive sheets prepared according to the present invention, it has been noted that in some instances the dyes contained in the adhesive layers migrate into the supporting sheet if the supporting sheets are made of porous material. The migrating dye may penetrate therethrough to the external surface thereof so that the appearance and quality of the adhesive sheet is spoiled and produce an outer appearance altogether different from the ordinary appearance of a conventional adhesive sheet. It is, of course, preferable to maintain adhesive sheets in which the supporting sheets are not spoiled by dyes migrating from the adhesive layers. Another purpose of the present invention is thus to prepare an adhesive sheet of the type comprising a supporting sheet and an adhesive layer formed on the supporting sheet and containing a dye, characterized by the presence of a dye anti-migration layer interposed between the supporting sheet and the adhesive layer. As a result of extensive research, the inventors have noted that supporting sheets made of paper, polypropylene, polyvinyl chloride, or urethane rubber can be spoiled by dyes migrating from the adhesive layer. Such migration, however, can be stopped by the interposition of a dye anti-migration layer comprising a polyester layer, a polycarbonate layer, a metallic foil, a metallic or non-metallic vapor deposition layer or the like.

Examples of the present invention incorporating a dye anti-migration layer are illustrated in FIGS. 3–7.

Figure 3:
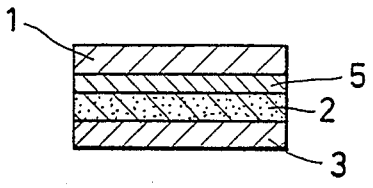

FIG. 3 illustrates an embodiment of the present invention in which a dye anti-migration layer 5 is interposed between the supporting sheet 1 and the adhesive layer 2. As in FIG. 1, the external surface of the adhesive sheet 2 is temporarily covered with a release sheet 3 which may be made of a silicone resin coated material. The dye anti-migration layer 5 is prepared from a dye migration inhibitor or a dye resistant material. The method for fixing the dye anti-migration layer 5 to the surface of the supporting sheet 1 depends upon the composition of the dye anti-migration layer 5. If it is made from a polymeric resin, a resin in the form of a film may be fused to be adhered to the supporting sheet or may be adhered through an appropriate adhesive to the supporting sheet or the resin may be mixed in an appropriate solvent and in liquid form coated onto the supporting sheet and dried. If the dye anti-migration layer 5 is made of a metallic foil, it may be adhered by an appropriate adhesive thereto to the supporting sheet. If the dye anti-migration layer is made of a vapor deposition layer, it is formed on the supporting sheet by one of the vacuum vapor deposition techniques known to the art. The dye anti-migration layer 5 prevents the dye contained in the adhesive layer 2 from migrating to the supporting sheet 1. Thus, the supporting sheet 1 may be paper, polypropylene, polyvinyl chloride, each of which would be inappropriate in the absence of a dye anti-migration layer 5. It should be noted that in the case of a dye anti-migration layer 5 prepared by vapor deposition it is desirable that it have a thickness of at least 300 angstroms.

Figure 4:
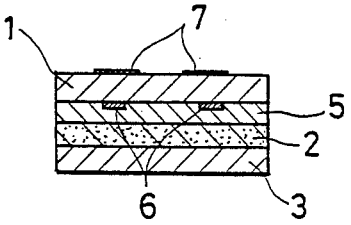

FIG. 4 shows another example of the present invention, in which supporting sheet 1 is made of paper which is opaque and strong. On the rear surface of supporting sheet 1 is a dye anti-migration layer 5 made from vapor deposition of metallic particles such as aluminum or metallic oxide particles such as aluminumoxide, to a thickness of 1,000 angstroms. The dye contained in the adhesive layer 2 may be a sublimation, a fluorescent whiting dye or mixture thereof. In addition, release agents 6 are applied to the rear surface of the supporting sheet 1. Predetermined printed parts 7 have been applied by a printing press to the outer surface of the supporting sheet 1. The dye anti-migration layer 5 of the adhesive sheet in FIG. 4 prevents dye contained in the adhesive layer from migrating to the supporting sheet 1. Once the adhesive sheet has been adhered to an object, and it is subsequently peeled away, there will remain on the surface of the object not only the broken pieces of the supporting sheets adhered thereto, but also the mark of the dye which migrated from the adhesive layer. Thereafter, even if the broken pieces of the supporting layer remaining on the object are wiped away together with the remaining adhesive parts from the surface of the object, the dye migrated to the object cannot be removed. The dye mark on the object will therefore indicate that an adhesive sheet had once been adhered thereto and that it had been subsequently removed.

Figure 5:
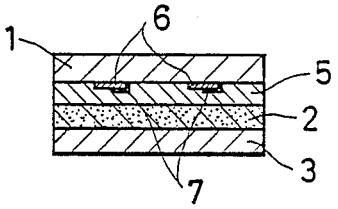

FIG. 5 illustrates an example of the present invention in which the supporting sheet 1 is made of a transparent synthetic resin film. Applied to the rear surface of the supporting sheet 1 are transparent coating layer parts of a release agent 6. Predetermined printing indication layer sections 7 are applied in such a manner that they extend from a release coating layer part 6 and the rear surface of the supporting sheet 1. The anti-migration layer 5 comprising a vapor deposition layer of aluminumoxide extends across the whole area of the rear surface of the supporting sheet 1 and has a thickness of 500 angstroms. The adhesive layer 2 containing a sublimation dye is coated on the outer surface of the dye anti-migration layer 5 by a coater. The outer surface of the adhesive layer 2 is temporarily attached to a silicone resin release sheet 3. The dye from the adhesive layer 2 does not migrate to the supporting sheet 7 because of the interposition of the dye anti-migration layer 5 therebetween. If the adhesive sheet 1 is adhered to an object and subsequently removed, the printed indication mark 7 is broken into two parts at the border between the release coating layer part 6 and the rear surface of the supporting sheet 1, thus the initial printing indication part 7 cannot be restored even if the peeled adhesive sheet is readhered to the object at its original position. Additionally, the indication display of the printed indication layer 7 of the adhesive sheet 1 readhered to the object looks blurred or clouded. Consequently, reuse of the adhesive sheet can be detected from its appearance. Further, once the adhesive sheet has been peeled from an object, there remains the dye mark on the object even if the residue of the broken pieces is wiped away and thus the removal fo the adhesive sheet 1 can be detected.

Figure 6:
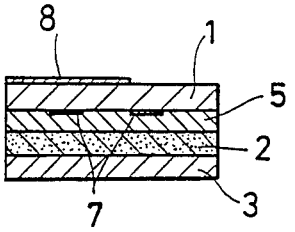

FIG. 6 shows an example of the present invention in which a microporous coating layer 8 suitable for receiving printing from a printer such as an impact sensitive printer, a thermal sensitive printer or the like, is formed on the outer surface of the supporting sheet 1. A printing indication layer part 7 is applied to the inner surface of the supporting sheet 1, and a dye anti-migration layer 5 comprising a polyester coating film is formed across the total inner surface area of the supporting sheet 1. The adhesive layer 2 is coated on the outer surface. The adhesive layer 2 contains a sublimation dye and is coated on the outer surface of the dye anti-migration layer 5. Coating layer 8 includes a printing indication display such as a lot number of production or the like. Dye anti-migration layer 5 prevents the dye contained in the adhesive layer 2 from migrating to the supporting sheet 1 so that the supporting sheet 1 is not spoiled by the dye. Even if the adhesive sheet 1 is peeled from an object to which it has been adhered, there remains on the object a mark from the migrated dye thus indicating that an adhesive sheet had been adhered to the object and subsequently removed. The migrated dye on the object cannot be removed even by a cloth impregnated with the solvent.

Figure 7:
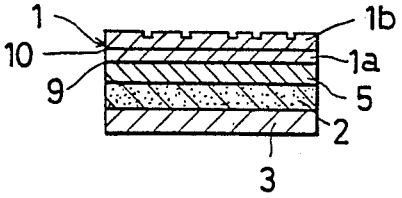

FIG. 7 shows an example of the present invention in which a metal foil is used as the dye anti-migration layer 5 and is adhered to the rear surface of the supporting sheet 1 by an adhesive 9. The supporting sheet 1 comprises a flat inner sheet 1A. An embossed outer sheet 1B bears an indication display such as letters, device marks, or the like resulting from an embossing operation. The embossed outer sheet 1B is adhered to the flat inner sheet 1A by an adhesive 10. As has been indicated above, the examples of the present invention, shown in FIGS. 3–7 retain a good appearance because of the interposition of the dye anti-migration layer 5 between the supporting sheet 1 and the adhesive layer 2. Further, the fact that an adhesive sheet had been applied and subsequently removed from an object will be apparent because of the migration of a dye from the adhesive layer to the object. The present invention thus has application as an authentication mark label for automobiles or their parts or accessories, for example. The examples of the present invention shown in FIGS. 4–6 are particularly difficult to counterfeit because of the intricacy of their manufacture.

The migration of the dye from the adhesive layer to the object to which the adhesive sheet has been adhered may be accelerated through the application of pressure and heat at an appropriate temperature from the outside, for instance, in the range of 50° to 125° C. An appropriate heating temperature for a polyvinyl chloride supporting sheet would be in the range of 50°–100° C., and the appropriate heating temperature for a polyester supporting sheet would be in the range of 50°–120° C.

The present invention may be more fully understood from the following examples which are intended to be illustrative and not intended to be limitations upon the scope of the invention.

EXAMPLE 1

Solvent Yellow 16 in an amount of 0.5 parts by weight was added to a transparent acrylic adhesive in the amount of 100 parts by weight, said adhesive being mainly composed of a copolymer of 2-ethylhexylacrylate, butylacrylate and vinyl acetate. The above mixture was coated onto a film of polyethylene terephthlate 50 micrometers thick producing an adhesive layer 25 micrometers thick. The resulting adhesive sheet was adhered to a baking finished, steel plate. The plate was left at room temperature for 24 hours and the adhesive sheet was subsequently peeled from the plate. A yellow dye mark was left behind on the white plate at the peeled site to which the adhesive sheet had been previously adhered.

EXAMPLE 2

Solvent Yellow 25 in an amount of 5 parts by weight was added to the transparent acrylic adhesive of Example 1 in an amount of 100 parts by weight. This mixture was then coated onto a fragile film of polyvinyl chloride which was 50 micrometers thick producing a coating adhesive layer 25 micrometers thick. The resulting adhesive sheet was adhered to a melamine baking finished, white, steel plate. The plate was left at room temperature for 168 hours and thereafter the adhesive sheet was removed from the plate through the application of toluene. A yellow dye mark remained on the plate at the site from which the adhesive sheet had been previously adhered.

EXAMPLE 3

Solvent Yellow 16 in an amount of 0.5 parts by weight and 2,5-bis(5-tertiary butylbenzoxylolyl(2)) thiophene in an amount of 2.5 parts by weight were added to the transparent acrylic adhesive of Example 1 in an amount of 100 parts by weight. The resulting mixture was coated onto a film of polyethylene terephthate with a thickness of 50 micrometers. The resulting coating adhesive layer had a thickness of 25 micrometers. This adhesive sheet was adhered to a melamine, baking, finished white, steel plate, which was left at room temperature for 24 hours and thereafter the adhesive sheet was peeled from the plate. A yellow dye mark and the emission of fluorescence were observed at the site of the plate from which the adhesive sheet had been peeled.

EXAMPLE 4

The sulfur dye of Example 3 in an amount of 0.32 parts by weight was added to the transparent acrylic adhesive of Example 1 in an amount of 100 parts by weight. The resulting mixture was coated onto a film of polyethylene terephthate having a thickness of 50 micrometers. The resulting coating adhesive layer had a thickness of 25 micrometers. Samples of the adhesive sheets from this example and from Examples 1, 2 and 3 were adhered to molded urethane rubber plates and molded polypropylene plates. These plates were left in a constant temperature oven for 3 days at which time the adhesive sheets were removed. Dye marks from the adhesive layers remained on the molded plates. Further, the emission of fluorescence from the plates was observed when they were irradiated with a black light.

Samples of the adhesive sheets obtained in Examples 1, 2, 3 and 4 above were adhered to melamine plates, urethane rubber molded plates and polypropylene plates. These plates were left at room temperature for five days at which time the sheets were peeled away. The dyed surfaces of the plates at the site of the peeled adhesive sheet were subjected to dye removing treatments by various types of solvents shown in the following Table 1. These attempts to remove the dye comprised the steps of (a) wiping the dyed surfaces with gauzes impregnated with the respective solvents and (b) dipping the respective plates in separate baths for 24 hours. After completion of the foregoing removing treatments, the surfaces of the plates were observed and irradiated with black lights to detect fluorescent emissions. The results of these tests are shown in Table 1. In that table, the circle symbol indicates that the migrated or transferred dye could not be removed from the surface of the plates, and the triangle symbol indicates that the migrated or transferred dyes were somewhat removed but for the most part remained unremoved. The results shown in Table 1 establish clearly that once the dyes have migrated to objects they cannot be easily removed by solvents and thus exhibit excelled solvent resistance.

EXAMPLE 5

The dyes listed in the following Table 2 were added to separate samples of the transparent acrylic adhesive of Example 1 in an amount of 100 parts by weight. The non-fluorescent dyes were each added in an amount of 1.29 parts by weight, while the fluorescent dyes were each added in an amount of 0.32 parts by weight. Each of the resulting mixtures was coated onto the a separate fragile polyvinyl chloride supporting sheet 50 micrometers thick to produce an adhesive layer of 25 micrometers in thickness thereon. The resulting adhesive sheets were adhered to separate melamine, baking finished, white, steel plates and left in a constant temperature oven for one day. Thereafter, the adhesive sheets were peeled off of the plates. The extent to which the dyes had transferred to the surfaces of the plates was noted and the results are shown in Table 2. These results show that all of the dyes were transferred, thus dying the plates. The circle symbol indicates the migration or transfer of the dye to the plate.

EXAMPLE 6

A polyester film 16 micrometers thick was applied as a dye anti-migration layer by an adhesive to the rear surface of good quality white paper supporting sheet. An adhesive prepared by mixing Solvent Yellow 16 in an amount of 0.5 parts by weight with the transparent acrylic adhesive of Example 1 in an amount of 100 parts by weight was coated onto the surface of the polyester film to produce an adhesive layer containing the dye and having a thickness of 25 micrometers. The resulting adhesive sheet was adhered to a melamine, baking finished, white steel plate and left at room temperature for 30 days. The white color appearance of the paper supporting sheet remained unchanged during that period. Further, when the adhesive sheet was removed from the plate, a yellow dye mark remained on the white plate at the site on which the adhesive sheet had been peeled away.

EXAMPLE 7

A silicon resin transparent release agent was applied to the rear surface of a fragile transparent polyvinyl chloride supporting sheet. An aluminum vapor deposition layer of about 600 angstroms in length was applied at a number of positions across the whole area of the rear surface of the supporting sheet. An adhesive prepared by mixing an acrylic adhesive of 100 parts by weight and solvent yellow dye no. 25 of 0.5 parts by weight and 2,5-bis(5-tertiary butyl benzoxylolyl(2)) theophine of 2.5 parts by weight was coated onto the surface of the vapor deposition layer in a thickness of 25 micrometers.

The resultant adhesive sheet was adhered to a white melamine baking finished steel plate and left at room temperature for twelve days. At the conclusion of that period it was noted that the appearance of the adhesive sheet had not changed, that it had not been spoiled by the dye contained in the adhesive layer. When the adhesive sheet was peeled from the plate, there was a yellow dye mark at the site on the white plate at which the peel had been removed. When the are was radiated with ultraviolet rays, fluorescent emissions were observed at the site at which the adhesive sheet had been removed. Thus, according to the present invention, the mark of the migratory from the adhesive layer remains on the object after the adhesive sheet has been removed. In another aspect of the present invention includes the interposition between the supporting sheet and an adhesive layer containing the dye of a dye anti-migratory layer thus preventing the spoiling of the support sheet by the dye contained in the adhesive layer.

TABLE 1

| Object to be adhered | Removing treatment | Gasoline | Window washer washing | Neutral detergent | Gear oil | Engine oil | 10 vol. % sulphuric acid | 2 wt. % NaOH aqueous solution |
|---|---|---|---|---|---|---|---|---|
| Melamine | (a) treatment | Δ | ○ | ○ | ○ | ○ | ○ | ○ |
| | (b) treatment | Δ | ○ | ○ | ○ | ○ | ○ | ○ |

TABLE 1-continued

| Object to be adhered | Removing treatment | Gasoline | Window washer washing | Neutral detergent | Gear oil | Engine oil | 10 vol. % sulphuric acid | 2 wt. % NaOH aqueous solution |
|---|---|---|---|---|---|---|---|---|
| Urethane rubber | (a) treatment | Δ | O | O | O | O | O | O |
| | (b) treatment | Δ | O | O | O | O | O | O |
| Polypro-pylene | (a) treatment | Δ | O | O | O | O | O | O |
| | (b) treatment | Δ | O | O | O | O | O | O |

TABLE 2

| Kind of dye | Type | Dyeability | Remark |
|---|---|---|---|
| Solvent yellow 25 | Sublimation | O | Soluble to oil |
| Solvent yellow 56 | " | O | " |
| Solvent yellow 14 | " | O | " |
| Disperse yellow 3 | " | O | " |
| Mixture of solvent red 4 & solvent yellow 14 | " | O | " |
| Mixture of solvent red 24 & solvent yellow 14 | " | O | " |
| Solvent red 27 | " | O | " |
| Solvent red 3 | " | O | " |
| Solvent blue 14 | " | O | " |
| Mixture of solvent blue 14 & solvent yellow 2 | " | O | " |
| Mixture of solvent green 23 & solvent blue 25 | " | O | " |
| Solvent black 3 | " | O | " |
| Disperse yellow 54 | " | O | Quinophthalone dye |
| Disperse red 60 | " | O | Anthraquinone dye |
| Coumarin fluorescent dye | | O | High content fluorescent whitening agent |
| Quinazolone derivative whitening fluorescent dye | | O | |
| Porylene derivative fluorescent whitening dye | | O | |

We claim:

1. A pressure-sensitive adhesive sheet, comprising:
a support sheet; and
a pressure-sensitive adhesive layer containing a migratory dye and being disposed on one side of said support sheet, said pressure-sensitive adhesive layer and said migratory dye being selected so that said migratory dye contained in said pressure-sensitive adhesive layer migrates from said adhesive layer with time into a surface of an article to which the adhesive sheet is attached, leaving a substantially unremovable mark on the surface of the article when the pressure-sensitive adhesive sheet is peeled off the surface of the article where the pressure-sensitive adhesive sheet had been attached.

2. The adhesive sheet of claim 1, wherein said migratory dye is present in an amount in the range of 0.1 to 10 parts by weight to 100 parts by weight of an adhesive.

3. The adhesive sheet of claim 1, wherein said migratory dye is a member selected from the group consisting of sublimation dyes and fluorescent dyes.

4. The adhesive sheet of claim 1, including a layer to prevent the migration of said migratory dye from said pressure-sensitive adhesive layer to said support sheet interposed between said pressure-sensitive layer and said support sheet.

5. The adhesive sheet of claim 4, wherein said layer comprises a material possessing a migratory dye resisting property.

6. The adhesive sheet of claim 4, wherein said layer comprises a member selected from the group consisting of a polyester resin layer, a polycarbonate resin layer, a metal foil layer, and a vapor deposition layer.

7. The adhesive sheet of claim 6, wherein said layer is a vapor deposition and is more that 300 angstroms thick.

8. The adhesive sheet of claim 4, wherein said layer to prevent migration comprises a member selected from the group consisting of a polyester resin layer, a polycarbonate resin layer, a metal foil layer, and a vapor deposition layer.

9. The adhesive sheet of claim 1, wherein said support sheet is comprised of a fragile material.

10. The adhesive sheet of claim 1, wherein a metallic vapor deposition layer is interposed between said support layer and said adhesive layer.

11. An adhesive sheet for attachment to an article, comprising:
a support sheet; and
an adhesive layer containing a migratory dye and being disposed on one side of said support sheet, said adhesive layer and migratory dye being selected so that said migratory dye will transfer from said adhesive layer into a surface of the article to provide a substantially unremovable mark on the article, when said adhesive layer is contacted with the surface of the article and then removed.

12. The adhesive sheet of claim 11, wherein said migratory dye is present in an amount in the range of 0.1 to 10 parts by weight to 100 parts by weight of an adhesive.

13. The adhesive sheet of claim 11, including a layer to prevent the migration of said migratory dye form from said adhesive layer to said support sheet and interposed between said pressure-sensitive layer and said support sheet.

* * * * *

UNITED STATES PATENT AND TRADEMARK OFFICE

CERTIFICATE OF CORRECTION

PATENT NO. : 4,841,652

DATED : June 27, 1989

INVENTOR(S) : SAKASHITA et al

It is certified that error appears in the above-identified patent and that said Letters Patent is hereby corrected as shown below:

On the cover page, Item [30], the following prior foreign application should also appear:

--Jan. 29, 1987 [JP] Japan ..... 62-17243--.

Signed and Sealed this

Fifteenth Day of May, 1990

*Attest:*

HARRY F. MANBECK, JR.

*Attesting Officer*

*Commissioner of Patents and Trademarks*